US005772014A

United States Patent [19]

Jacober

[11] Patent Number: 5,772,014

[45] Date of Patent: Jun. 30, 1998

[54] CONTACT LENS CARRYING CASE

[75] Inventor: Jeffrey M. Jacober, Providence, R.I.

[73] Assignee: MEDport, Inc., Providence, R.I.

[21] Appl. No.: 656,860

[22] Filed: May 30, 1996

[51] Int. Cl.[6] ..... A45C 11/00

[52] U.S. Cl. ..... 206/5.1; 150/116

[58] Field of Search ..... 206/5, 5.1; 190/100, 190/107, 109, 110; 150/116

[56] References Cited

U.S. PATENT DOCUMENTS

| | | | |
|---|---|---|---|
| D. 284,715 | 7/1986 | Jacober et al. . | |
| D. 299,406 | 1/1989 | Jacober . | |
| D. 322,358 | 12/1991 | Jacober et al. . | |
| 4,706,856 | 11/1987 | Jacober . | |
| 4,723,657 | 2/1988 | Robinson | 190/110 X |
| 4,767,039 | 8/1988 | Jacober . | |
| 4,940,173 | 7/1990 | Jacober . | |
| 4,984,662 | 1/1991 | Jacober . | |
| 5,090,526 | 2/1992 | Jacober . | |
| 5,211,288 | 5/1993 | Beall | 190/109 X |

*Primary Examiner*—Jacob K. Ackun
*Attorney, Agent, or Firm*—Lockwood, Alex, Fitzgibbon & Cummings

[57] ABSTRACT

A contact lens carrying case is disclosed which includes a top panel, a bottom panel, two opposing side panels, two opposing end panels, and an intermediate panel. The top panel, bottom panel, side panels and end panels are joined together in standard fashion at respective edges of the carrying case. The intermediate panel is hingedly connected with one of the case's two opposing side panels. A first set of contact lens storage compartments is found on the underside of the top panel. A second set of similar storage compartments is found on the underside of the intermediate panel. In this arrangement, the carrying case is able to selectively store, display and separate both right-eye prescription contact lenses and left-eye prescription contact lenses in a convenient and attractive manner.

4 Claims, 3 Drawing Sheets

CONTACT LENS CARRYING CASE

BACKGROUND OF THE INVENTION

The present invention is generally directed to soft-walled cases for carrying contact lenses. More particularly, the present invention is directed to a soft-walled case which includes an intermediate panel hingedly attached to one of the two side panels of the case. The intermediate panel allows the case to selectively separate and effectively display contact lenses and the like for facilitating their selection by the user.

Soft-walled carriers for carrying a variety of items are well known. Prior contact lens carrying cases have generally included a body portion defining an enclosure for carrying the lenses. While in their closed configuration, these prior contact lens carrying cases generally assume a three-dimensional rectilinear shape, much like a standard rectangular box. One panel of these prior contact lens carrying cases, typically the top panel, is opened to expose the contents stored within the enclosure provided by the case. Typically, contact lenses are stored within that enclosure. After opening the case, the contact lenses are removed for insertion over the wearer's eyes.

Although these prior contact lens carrying cases have proven adequate in a few limited applications, they do not measure up to the benefits achieved through the use of the present invention. Contact lens wearers have long appreciated the need to separate their right-eye prescription contact lenses from their left-eye prescription contact lenses while those lenses are temporarily stored within a carrying case. This separation reduces the likelihood of placing a right-eye prescription contact lens over the wearer's left eye, or vice versa. In the typical situation, a contact lens wearer requires a different prescription for each eye. Therefore, it is important in a very practical sense to separate the contact lenses prescribed for the wearer's right eye from the contact lenses prescribed for the wearer's left eye while storing those lenses.

Prior art contact lens carrying cases offered no suitable solution to this practical problem. Thus, while using the prior art contact lens carrying cases, contact lens wearers would sometimes negligently insert their left-eye prescription contact lens over their right eye, or vice versa. Most importantly, proper insertion of the lenses became even less likely in unlit or dark environments such as a bedroom at night or under other circumstances under which it may be difficult to distinguish between a label for right-eye storage from one for left-eye storage.

As will be apparent from the description below, the carrying case of the present invention selectively separates right-eye prescription contact lenses from left-eye prescription contact lenses while those lenses are stored within the case.

In addition to separating the right-eye prescription contact lenses from the left-eye prescription contact lenses, the carrying case of the present invention permits convenient and attractive display of those lenses while in its fully open configuration. Once again, the prior art contact lens carrying cases did not exhibit this characteristic. The present invention utilizes several of its unique structural and functional features, particularly its hingedly-attached intermediate panel, to provide for a functionally superior result, namely the laid-out display of the separated right-eye and left-eye prescription contact lenses.

The prior art carrying cases often made it difficult to remove contact lenses from the body portion of the case.

However, the carrying case of the present invention facilitates the removal of these contact lenses from the case. In particular, the case displays the contact lenses outside of its body portion when the case is in its fully open configuration. Unlike prior art contact lens carrying cases, the body portion of the case of the present invention also may freely retain items other than contact lenses. For instance, saline solution containers which further facilitate the insertion of the contact lenses over the wearer's eyes may be stored within the case's body portion.

Accordingly, it is a general object of the present invention to provide a new and improved contact lens carrying case.

It is a more specific object of the present invention to provide a contact lens carrying case which is designed to facilitate the removal of contact lenses therefrom.

It is a still more specific object of the present invention to provide a contact lens carrying case which permits the separated storing of right-eye prescription contact lenses from left-eye prescription contact lenses.

Yet another object of the present invention is to provide a contact lens carrying case which, through its structural and functional features, displays the contact lenses in a convenient and attractive manner, particularly when the case is in its fully open configuration.

SUMMARY OF THE INVENTION

A case for carrying contact lenses according to the present invention includes a top panel, a bottom panel, a first side panel, a second side panel opposing the first side panel, a first end panel, a second end panel opposing said first end panel, and an intermediate panel. A hinge attachment hingedly connects the intermediate panel with the second side panel. The bottom panel is joined with the first and second side panels and the first and second end panels, respectively, at a first plurality of edges of the case. The top panel is capable of being joined with the first and second side panels and with the first and second end panels, respectively, at a second plurality of edges of said case.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DETAILED DESCRIPTION OF THE PREFERRED EMBODIMENT

Figure 1:
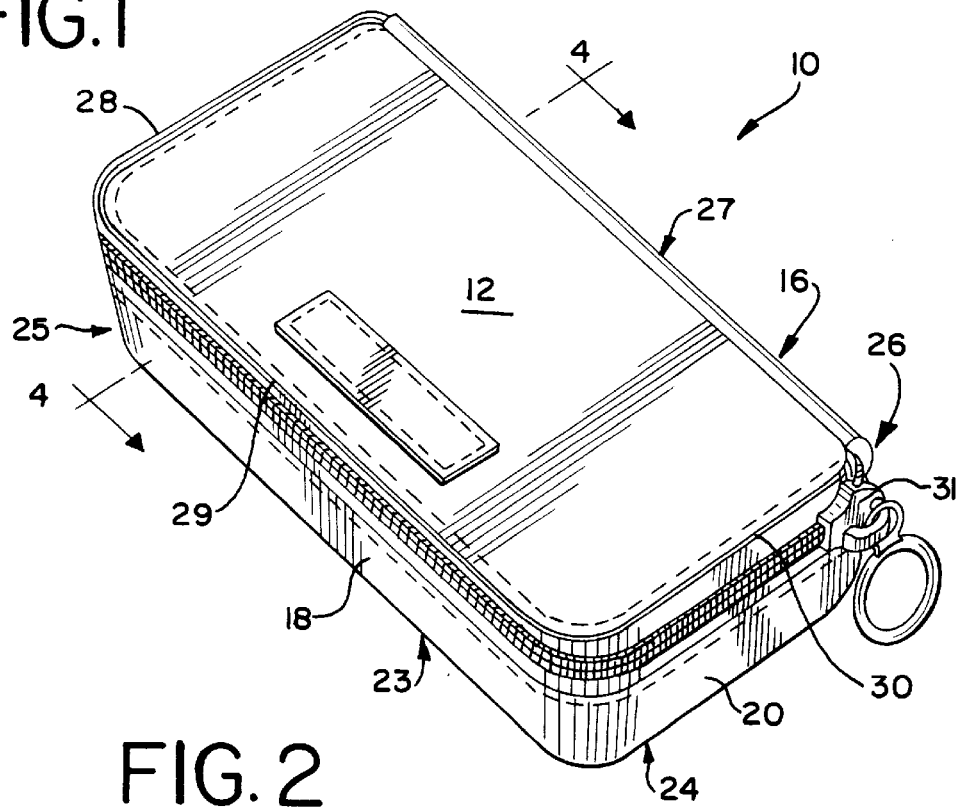
FIG. 1 is a perspective view of a contact lens carrying case constructed in accordance with the invention and shown in its closed configuration.

Referring generally to FIGS. 1–5, and more particularly to FIG. 1, a new and improved contact lens carrying case 10 is shown. The carrying case includes a top panel 12, a bottom panel 14 opposite the top panel, two opposing side panels 16 and 18, and two opposing end panels 20 and 22. Bottom panel 14 is joined together with side panels 16 and 18 and with end panels 20 and 22 at respective edges 23, 24, 25 and 26 of carrying case 10. Top panel 12 and side panel 16 are preferably joined at edge 27 of carrying case 10. In the preferred embodiment described and shown in FIGS. 1–5, top panel 12 is selectively and releasably secured with side panel 18 and with end panels 20 and 22 at edges 28, 29 and 30 of carrying case 10. A releasable attachment assembly, which is shown in the preferred embodiment as a zipper 31, provides this selective and releasable attachment of top panel 12 with panels 18, 20 and 22. Zipper 31 may be conventional in design and may operate as is well known in the art.

Figure 2:
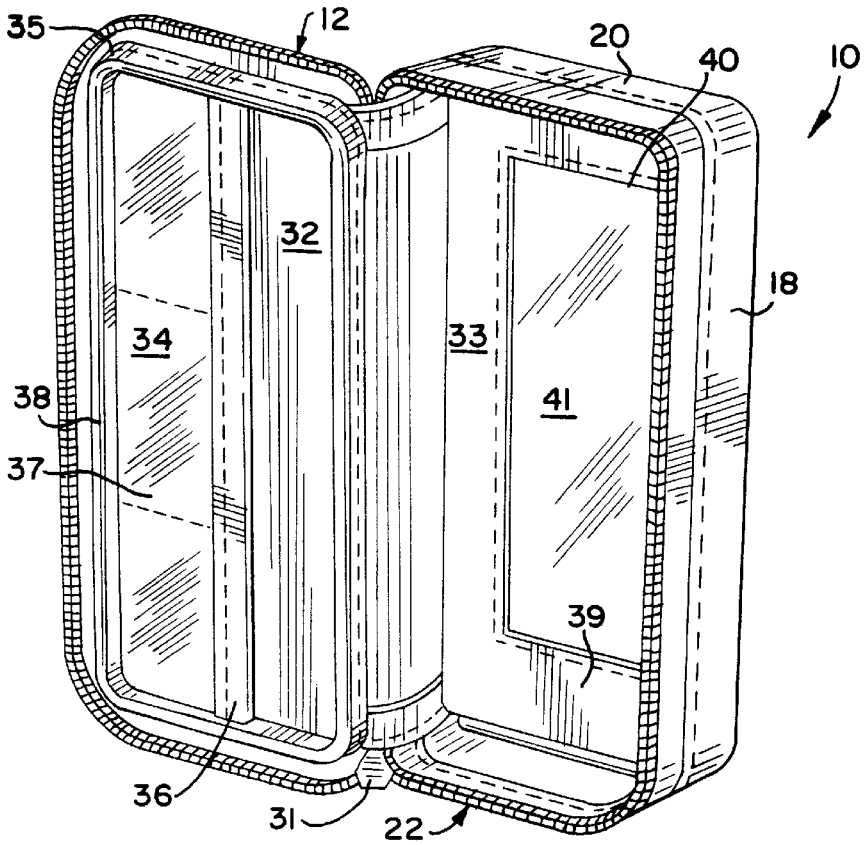
FIG. 2 is a perspective view of the contact lens carrying case of FIG. 1 shown in its partially open configuration.

Referring now to FIG. 2, carrying case 10 is shown in its partially open configuration. To partially open the carrying case, it is necessary to merely unzip (or otherwise manipulate) the attachment assembly so that top panel 12 is released from side panel 18 and end panels 20 and 22. Top panel 12 is then turned over at edge 27 to expose its underside 32 while it is outside of the body portion 33 of the case. Body portion 33 is defined by the bounded volume of the case's enclosure while the case is in its closed configuration as shown in FIG. 1.

Referring back to FIG. 2, the underside 32 of top panel 12 includes a plurality of contact lens storage compartments generally designated as reference numeral 34. Compartments 34 selectively store prescription contact lenses. Preferably, the contact lens wearer will store his left-eye prescription contact lenses in compartments 34. Accordingly, when the case is properly oriented as shown in FIG. 2, the left-eye lenses will always be on the left, a location which can be readily determined even in the dark, for example.

In the preferred embodiment, contact lens storage compartments 34 comprise a generally rectilinear-shaped facing strip 35, a fabric strip 36, and a plastic strip 37. Facing strip 35, which is preferably made from a polymer sheeting, extends substantially along the outer perimeter of underside 32 of top panel 12. Fabric strip 36 preferably extends across underside 32 and is sewn to opposing sides of the rectilinear-shaped facing strip 35. Plastic strip 37 is preferably secured to fabric strip 36 and to selected portions of the sides of facing strip 35 as shown. Plastic strip 37 is then also attached to underside 32 along generally-parallel lines which are spaced apart by predetermined distances, forming compartments 34. Preferably, the compartments are formed using a series of generally-parallel sewing lines. With the described arrangement, the left-eye prescription contact lenses may be selectively stored within compartments 34.

To store those contact lenses, the wearer must simply place the lenses within the bounded volume of plastic strip 37 and underside 32 (comprising the first dimension of the bounded volume), side 38 of facing strip 35 and fabric strip 36 (comprising the second dimension of the bounded volume), and any two adjacent of the generally-parallel sewing lines, or, alternatively, one such sewing line and a portion of facing strip 35 spaced apart from but adjacent to it (comprising the third dimension of the bounded volume). It is to be appreciated that fabric strip 36 helps secure the left-eye prescription contact lenses within storage compartments 34 and forms the entry and exit point for those contact lenses to and from the compartments, respectively.

FIG. 2 further shows an intermediate panel 39 which remains within the body portion 33 of carrying case 10 when that case is in its partially open configuration. As shown, intermediate panel 39 preferably includes an opening 40 and a reflection element, which is shown as a mirror 41. Mirror 41 may be placed within the interior of intermediate panel 39, making that panel substantially rigid. In this preferred embodiment, a portion of mirror 41 may be exposed through the area defined by opening 40 to allow readily accessible reflection for the contact lens wearer, particularly during the ultimate insertion of the contact lenses over the wearer's eyes.

Figure 3:
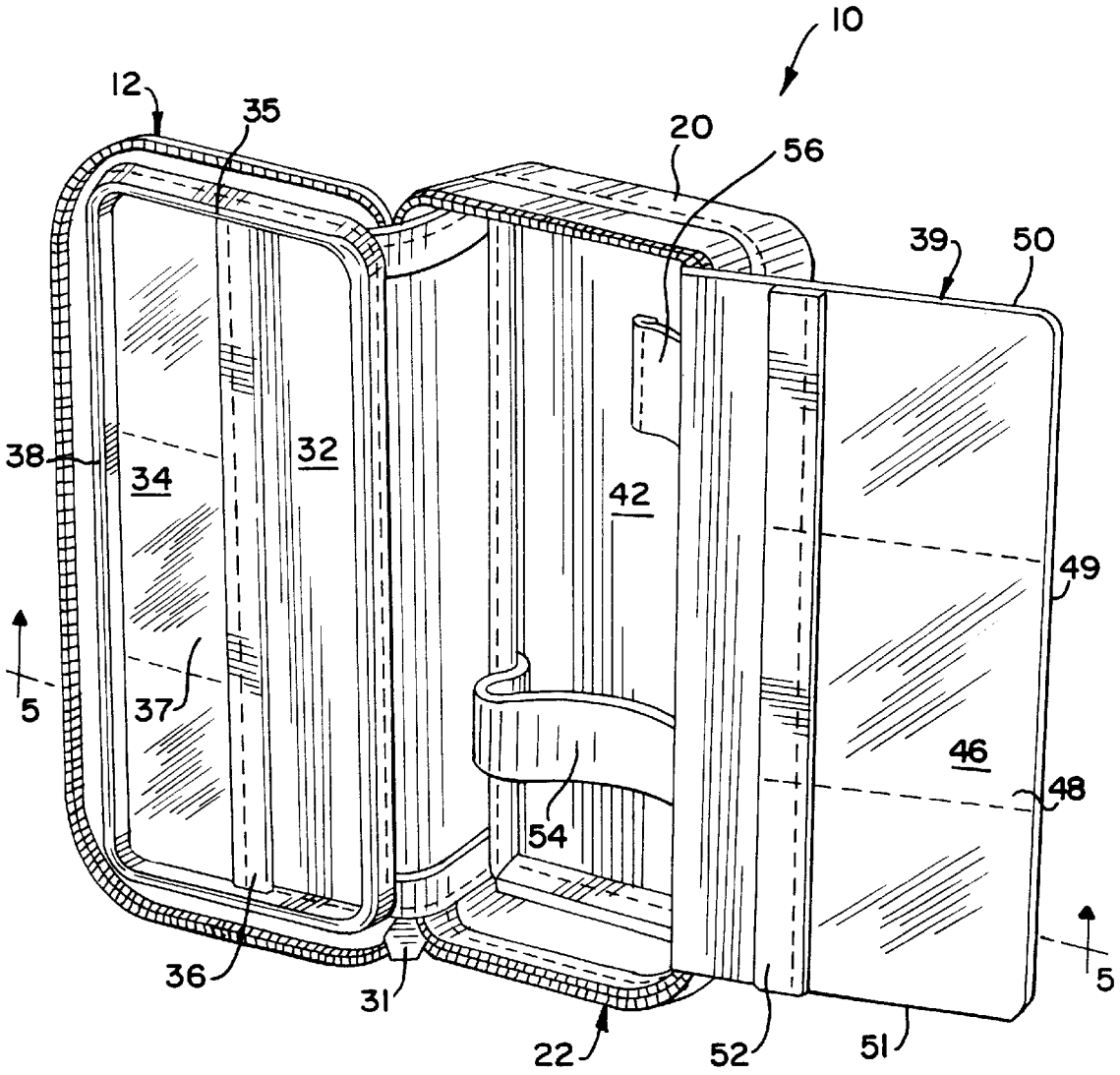
FIG. 3 is a perspective view of the contact lens carrying case of FIGS. 1 and 2 shown in its fully open configuration.

Referring now to FIG. 3, carrying case 10 is shown in its fully open configuration. To fully open carrying case 10 from its partially open configuration as shown in FIG. 2, intermediate panel 39 is simply removed from the body portion 33 of the case. In particular, intermediate panel 39 is folded over at edge 29 of the case so that the underside 42 of the intermediate panel may be seen by the contact lens wearer. A hinge attachment 43 (see FIGS. 4 and 5) hingedly connects intermediate panel 39 to side panel 16 along an attachment line 44 which is adjacent to edge 29 of carrying case 10. In the preferred embodiment shown, hinge attachment 43 comprises a double-hinged assembly, the advantages of which are described below.

Underside 42 includes a second plurality of contact lens storage compartments 46 which may be similar in design and construction to compartments 34 found on the underside 32 of top panel 12. In practice, however, it has been found that the use of a facing strip similar to facing strip 35 is not necessary nor desirable to facilitate the formation of storage compartments 46. Instead, a plastic strip 48, similar to plastic strip 37, is attached (preferably by sewn stitch) along edge 49 of intermediate panel 39 and along portions of opposing edges 50 and 51 of the intermediate panel. A fabric strip 52, similar to fabric strip 36, extends across the underside 42 of intermediate panel 39 from edge 50 to opposing edge 51. Terminating ends of fabric strip 52 are attached to edges 50 and 51, respectively.

A series of generally parallel sewing lines, much like the sewing lines forming left-eye prescription contact lens storage compartments 34, preferably form the plurality of right-eye prescription contact lens storage compartments 46. Similar to compartments 34, the right-eye prescription contact lenses placed in compartments 46 are secured by the bounded volume of plastic strip 48 and underside 42 of intermediate panel 39 (comprising the first dimension of the bounded volume), fabric strip 52 and edge 49 of the intermediate panel (comprising the second dimension of the bounded volume), and any two adjacent ones of the generally-parallel sewing lines, or, alternatively, one such sewing line and a portion of opposing edge 50 or 51 of the intermediate panel adjacent to it (comprising the third dimension of the bounded volume). It is to be appreciated that fabric strip 52 helps secure the right-eye prescription contact lenses within storage compartments 46 and forms the entry and exit point for these lenses to and from the compartments, respectively. Due to the unique structural features of carrying case 10, the right-eye and left-eye prescription contact lenses are selectively separated while they are stored in the case to prevent the undesirable consequences resulting from insertion of a left-eye prescription contact lens over the wearer's right eye, or vice versa. Accordingly, when the case is in its fully open configuration as shown in FIG. 3, the case exposes both sets of contact lenses, making them readily visible and conveniently available to their wearer, while simultaneously orienting the left-eye lenses on the left side of the open case and the right-eye lenses on the right side of the open case.

While in its fully open configuration as best shown in FIG. 3, carrying case 10 also exposes any items which may be selectively stored within its body portion 33. Elastic strips 54 and 56 are preferably included within the body portion 33 of carrying case 10 to permit the selective storing of saline solution containers or other objects which further facilitate the insertion of contact lenses over the wearer's eyes.

Figure 4:
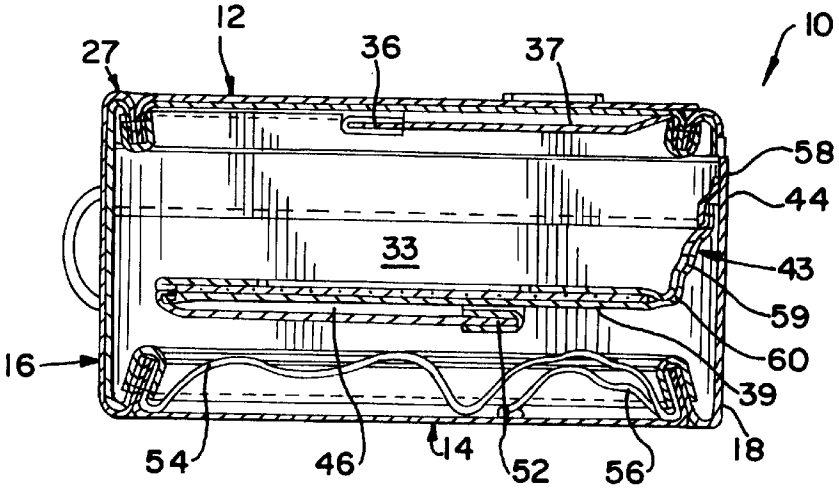
FIG. 4 is a cross-sectional view of the contact lens carrying case taken along line 4—4 of FIG. 1.
Figure 5:
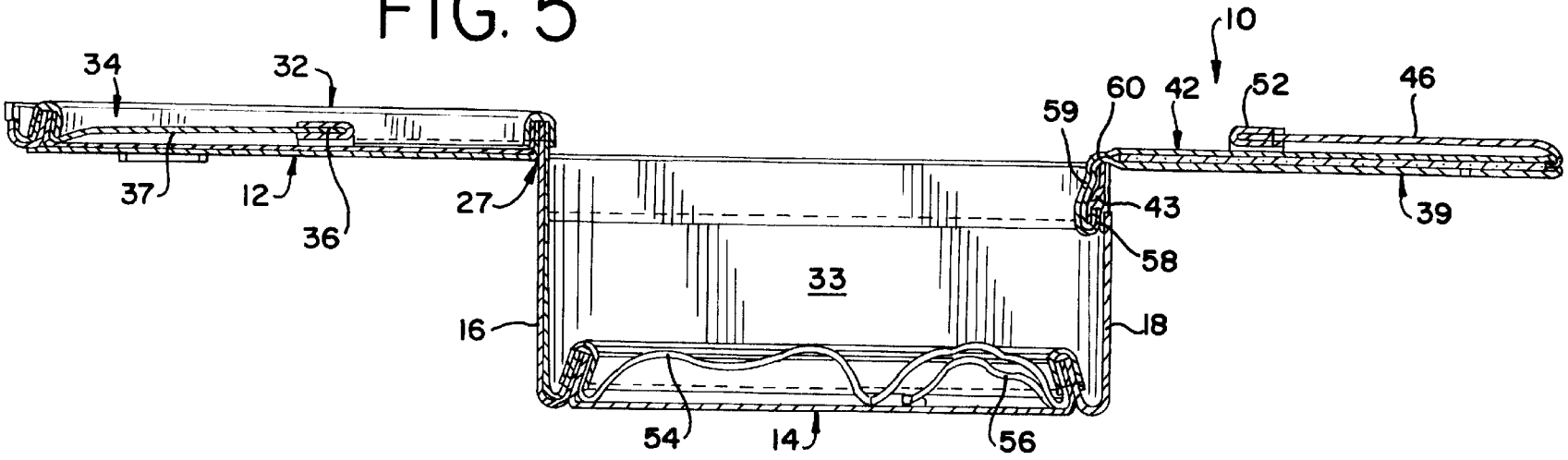
FIG. 5 is a cross-sectional view of the contact lens carrying case taken along line 5—5 of FIG. 3.

Referring now to FIGS. 4 and 5, carrying case 10 is shown in its closed and in its fully open configurations, respectively. Focusing on hinge attachment 43, it is to be appreciated that the attachment performs a useful and novel function for the present invention which is not found in the prior art. As shown, hinge attachment 43 preferably comprises a double-hinged assembly. While carrying case 10 is in its closed configuration, hinge attachment 43 ensures that intermediate panel 39 is stored within the case's body portion 33 and that the intermediate panel rests between and in a generally-parallel relationship with top panel 12 and bottom panel 14. On the other hand, while the case is in its fully open configuration, hinge attachment 43 ensures that intermediate panel 39 is removed from the body portion 33 of case 10, thereby permitting access to the right-eye prescription contact lenses stored within compartments 46.

In its preferred double-hinged embodiment, hinge attachment 43 maintains the integrity of the body portion 33 of carrying case 10 while that case is in its fully open configuration. As is best shown in FIG. 5, a first hinge 58 of hinge attachment 43 connects a portion of intermittent material 59 with side panel 16 along attachment line 44. When carrying case 10 is in its fully closed configuration (see FIG. 4) and bottom panel 14 is placed upon an external surface (such as a table), intermittent material 59 assumes a generally vertical orientation due to the natural effects of gravity. A second hinge 60 of hinged attachment 42 connects intermediate panel 39 with intermittent material 59. Intermittent material 59 is preferably more pliable than the substantially rigid intermediate panel 39 to allow the intermediate panel to assume a generally horizontal orientation under these circumstances. Further, intermediate panel 39 rests generally parallel with and between top panel 12 and bottom panel 14.

It is to be appreciated that, even in the preferred double-hinged embodiment, intermediate panel 39 is operatively connected with side panel 16 through hinge attachment 43 and its intermittent material 59. Further, it is to be appreciated that the preferred width of intermittent material 59 (shown in FIG. 4) is approximately equal to the distance between attachment line 44 and edge 29 of carrying case 10, thereby ensuring that hinge attachment 43 maintains the integrity of the body portion 33 of the case when that case is in its fully open configuration.

The structural elements of contact lens carrying case 10 permit the selective separation of right-eye prescription contact lenses from left-eye prescription contact lenses. Further, these elements ensure the attractive display of those contact lenses when the case is in its fully open configuration. While in that configuration, the carrying case exposes both sets of the contact lenses, making them readily visible and conveniently available to their wearer, while simultaneously orienting the left-eye lenses on the left side of the open case and the right-eye lenses on the right side of the open case.

Although the present invention has been described with reference to a certain preferred embodiment, it will be understood by those skilled in the art that changes and modifications may be made therein without departing from the invention in its broader aspects and, therefore, the aim in the appended claims is to cover all such changes and modifications as fall within the true spirit and scope of the invention.

I claim:

1. A contact lens carrying case comprising:

a top panel;

a bottom panel opposing said top panel;

a first side panel;

a second side panel opposing said first side panel;

a first end panel;

a second end panel opposing said first end panel;

an intermediate panel;

a double-hinged assembly;

a first hinge of said double-hinged assembly connecting said double-hinged assembly with said second side panel along an attachment line;

a second hinge of said double-hinged assembly connecting said double-hinged assembly with said intermediate panel;

intermittent material between said first hinge and said second hinge, the intermittent material being substantially more pliable than said intermediate panel;

the bottom panel being joined with said first and second side panels and said first and second end panels to form a first plurality of edges of said case;

the top panel being nonreleasably joined with said first side panel to form a first edge of a second plurality of edges of said case;

a zipper that releasably and selectively secures said top panel with said second side panel and said end panels to form additional edges of the second plurality of edges;

a first plurality of contact lens storage compartments on said top panel; and a second plurality of contact lens storage compartments on said intermediate panel.

2. The case as defined in claim 1 wherein said intermediate panel is connected only to said second side panel.

3. The case as defined in claim 1 wherein a reflection element within the intermediate panel makes that panel substantially more rigid than said intermittent material.

4. The case as defined in claim 1 wherein an element within the intermediate panel makes that panel substantially more rigid than said intermittent material.

* * * * *